United States Patent [19]

Schupphaus

[11] Patent Number: 4,691,967

[45] Date of Patent: Sep. 8, 1987

[54] APPARATUS FOR CONTROLLING THE DISCHARGE OF PRESSURIZED LIQUID FROM NOZZLES ON A CUTTING DRUM OF A MINING MACHINE

[75] Inventor: Herbert Schupphaus, Bochum, Fed. Rep. of Germany

[73] Assignee: Gebr. Eickhoff Maschinenfabrik and Eisengiesserei m.b.H., Bochum, Fed. Rep. of Germany

[21] Appl. No.: 793,224

[22] Filed: Oct. 31, 1985

[30] Foreign Application Priority Data

Nov. 13, 1984 [DE] Fed. Rep. of Germany ..... 3441397

[51] Int. Cl.[4] ..... E21C 35/22; E21C 25/60; E21F 5/02

[52] U.S. Cl. ..... 299/1; 299/17; 299/81

[58] Field of Search ..... 299/81, 17, 1

[56] References Cited

U.S. PATENT DOCUMENTS

| | | | |
|---|---|---|---|
| 3,980,338 | 9/1976 | Weber | 299/17 X |
| 4,285,549 | 8/1981 | Zitz et al. | 299/81 X |
| 4,367,900 | 1/1983 | Trumper | 299/1 |
| 4,403,664 | 9/1983 | Sullinger | 299/1 X |
| 4,465,155 | 8/1984 | Collins | 299/1 X |
| 4,573,743 | 3/1986 | Grathoff | 299/39 |

*Primary Examiner*—Sephen J. Novosad
*Assistant Examiner*—Michael A. Goodwin

[57] ABSTRACT

A liquid discharge control system is provided for nozzles on a shearer or cutter drum for a drum-type shearer loader or heading or drifting machine used in underground mining. In addition to liquid discharge nozzles are distributed about the periphery of the cutter drum there is also provided cutting tools which are distributed about the periphery of the cutter drum. A liquid supply line delivers pressurized water to a valve for each nozzle or a group of nozzles. The valves are operated to control the discharge of water from only those nozzles or group of nozzles which are opposite the mineral face operated on by the cutting tools. The nozzles spray high-pressure jets of water to assist the cutting operation of the tools, to control dust or for suppressing sparks. Electrical control signals are produced to open and close the valves. The control signals are delivered from a microrprocessor which is triggered during rotation of the drum by output signals from one or more initiators. The microprocessor also receives output signals from angle detectors responsive to movement of a support arm which pivotally positions the cutter drum.

25 Claims, 9 Drawing Figures

APPARATUS FOR CONTROLLING THE DISCHARGE OF PRESSURIZED LIQUID FROM NOZZLES ON A CUTTING DRUM OF A MINING MACHINE

BACKGROUND OF THE INVENTION

This invention relates to a mining machine having nozzles distributed about on the periphery of a cutting drum in which the nozzles are controlled singularly or in groups by a valve for the discharge of liquid, preferably, high-pressure liquid from those nozzles directed toward the mine face. The mining machine of the present invention may take the form of a drum shearer loader, having a shearer or cutter drum or a heading machine or a drifting machine of the type used in underground mining.

It is known in the art to provide nozzles or groups of nozzles on the periphery of a shearer or cutter drum. The nozzles are supplied with highpressure water to boost the cutting action of the cutter picks and the nozzles can be supplied with lower-pressure liquid for controlling dust. Each of the nozzles or groups of nozzles is connected to a liquid supply line of the drum only when they are directed toward the mineral face. The nozzles on the part of the periphery of the drum which is remote from the mineral face are not supplied with liquid. The purpose for limiting the duration of discharge of liquid by the nozzles is to limit the consumption of liquid to an unavoidable minimum.

In this way, the consumption of power required to distribute and spray the liquid is reduced and the risk to the machine operative parts is obviated even when high-pressure liquid is used. However, an expensive control system is needed to ensure that only the nozzles or nozzle groups which are near the mineral face are energized to discharge liquid as the drum rotates.

During the operation of winning material from the mine face, the zone of nozzles on the drum which is to be supplied with liquid undergoes a change with respect to the position and size of the zone when the cutting horizon of the drum is adjusted. Changes to the spray zone for a cutting drum are particularly prevalent with a cutter or shearer drum of a heading or drifting machine. The machine is guided continuously in a vertical or horizontal direction over the heading or drift face during the pivotal movement of the support arm which carries the cutter drum. Changes to the spray zone are also prevalent in shearer-loaders, particularly when the direction of movement by the loader changes where the cutting horizons of the two cutting drums are adjusted. Every change in the direction of movement by the support arm for the cutting drum and any change in the cutting horizon brings the rotating cutting tools of a different zone of the drum into engagement with the mineral to be released from the mine face. Energization of the nozzles for the delivery of liquid therefrom precisely at the peripheral zone facing the material to be won must be precisely controlled not only because of the direction of pivotal movement by the support arm but also because the depth of penetration of the drum into the heading or drift face is frequently altered. Similar problems for controlling the discharge of liquid from nozzles occur with longwall mining machines, i.e., drum type shearer-loaders, since in the operation of such mining machines, the trailing drum is positioned to cut coal at the floor of the mine and the height of the cut by the trailing drum is determined by the diameter of the cutting drum at the leading end of the mining machine and by the inclination of the support arm for the drum at the leading end.

SUMMARY OF THE INVENTION

It is an object of the present invention to provide a very simplified construction and accurate control for energizing the flow of liquid to nozzles on a cutting drum when the nozzles are directed at the working face of a mine and to provide that the control adjusts the position of the zone of the drum which is to be supplied with liquid to register with the position of the drum with respect to the mineral face to be won.

More particularly, according to the present invention there is provided in a mining machine used in underground mining, the combination of a cutter drum, nozzles distributed about the periphery of the drum for discharging pressurized liquid outwardly from the drum, liquid control valve means for controlling the supply of pressurized liquid to each nozzle or a group of nozzles, at least one initiator means responsive to rotation of the drum for producing a signal, and microprocessor means responsive to the signal produced by the initiator means for controlling the valve means to limit the discharge of pressurized liquid from the nozzles toward only that part of the mineral face which is in front of the drum.

Thus, there is provided according to the present invention at least one initiator which is associated with a cutting drum which can be a shearer or cutter drum. The initiator controls the energization of the individual nozzles or nozzle groups in a dependent relation to rotation of the drum. A microprocessor forms a means which responds to a signal produced by the initiator to limit the energization of nozzles or group of nozzles in a zone in a dependent relation upon rotation of the drum so that the energization zone of nozzles is limited to that part of the mineral face which is in front of the drum. In a nozzle control system for a cutter drum of this type, a tag rotates with the drum and produces a control signal whenever the tag passes the initiator which is fixedly supported inside or outside the drum. The microprocessor responds by actuating electrically-controlled valves in a serial fashion to deliver liquid from a liquid line of the drum whenever nozzles or a group of nozzles are at that instant in time entering the mineral face.

Each of a plurality of valves can be controlled by a separate initiator. All initiators feed signals to a common microprocessor to control a valve associated with and connected to the nozzle or groups of nozzles. The initiators can be disposed on a component inside the drum and such component may or may not rotate with the drum. In the event a separate initiator is provided for each valve, whenever the initiators pass a stationary tag as the drum rotates or alternatively when a tag passes the initiators which are fixedly disposed, a signal is delivered in a serial fashion to the microprocessor for actuating the valves. Closure of the valves can be triggered by a signal produced by a second tag which is offset from a first tag by an angle subtended at the center of the drum by an arc of the mineral face which is in front of the drum.

Alternatively, a single initiator can be provided to deliver with each revolution of the drum an output signal to the microprocessor which in turn produces output signals in a timed sequence with the speed of the drum. The control signals are used to open and close the valves for supplying pressurized liquid to the nozzles directed toward the mineral face in front of the drum. In this event, whenever the tag passes the initiator which is fixedly disposed inside or outside the drum, a control signal is supplied to the microprocessor. The signal occurs only once per revolution of the drum. A train of pulses from the microprocessor is produced to actuate the valves consecutively in a timed relation so that as the nozzles or group of nozzles enter the mineral face, each entering nozzle or group of nozzles is supplied with pressurized liquid. After a half revolution of the drum, which can be denoted for example, by a fixed number of pulses in the microprocessor, the control signal which keeps the valves open, decays and the valves reclose at cadence of the nozzles or group of nozzles issuing from the mine face without interrupting the enabling cadence of the nozzles or group of nozzles entering the mine face. This control operation ends only after one complete revolution of the drum unless restarted by a control signal from the initiator and tag. Closure of the valves can, of course, be initiated through the microprocessor by means of a second control signal provided by the initiator and triggered by a second tag. Alternatively, a second microprocessor can be controlled by its own initiator which is provided for this purpose.

Conveniently, for shearer-cutter drums which are mounted for vertical displacement on a drum shearer-loader by means of an interconnecting pivotal support arm, an initiator is disposed on the support arm very near to the drum so that a tag which rotates with the drum cuts lines of flux of the initiator. The tag is adjustable in the plane of its rotation with the drum. When the position of the tag is adjusted, there is a corresponding change to the position of the zone in which the microprocessor acts to control the discharge of fluid by operation of the valves. Consequently, the signal supplied by the initiator varies in a dependent manner upon direction which the tag is adjusted whereby the microprocessor supplies control signal pulses to the requisite valve or valves to, in turn, supply the requisite nozzles or groups of nozzles with liquid at a time occurring sooner or later during each revolution of the drum. Whenever the position of the tag is adjusted to a correct position relative to the mineral face then as the tag rotates past the initiator, the initiator provides a signal which harmonizes the operative zone of the nozzles with the position of the mineral face.

More advantageously, the pivotal support arm for a cutting drum is provided with an angle detector which provides an output signal as an input to the microprocessor of the cutter drum. The output signal from the angle detector corresponds to an angle of inclination $\beta$ between the support arm and the floor. The microprocessor responds to the inclination signal by shifting the energization zone of the nozzles or group of nozzles either through an angle $\alpha$ corresponding to the support arm inclination $\beta$ or through an integral multiple of the angle $\alpha$ against the inclination of the support arm. The angle $\alpha$ corresponds to the angle subtended from the center of the drum either by the peripheral segment of the drum containing a nozzle group or a peripheral circular segment of the drum formed by an interval between two consecutive rows of nozzles extending across the width of the drum. When a control signal of this type is supplied to the microprocessor for a cutter drum, the zone of the nozzles to be supplied with liquid is shifted independently of the machine operator. When the inclination of the support arm reaches the value predetermined by the angle $\alpha$ or a multiple thereof, the nozzles in a zone of the drum to be energized are displaced by one or more steps defined by the angle $\alpha$ against the direction of pivotal movement by the support arm. In this way, the zone of nozzles from which fluid is discharged corresponds with the position of the mineral face in front of the drum. This liquid discharge control is particularly advantageous when the angle $\alpha$ is small either due to a small interval between rows of nozzles or due to a narrow peripheral zone of the drum on which a group of nozzles is disposed.

It is further possible, according to the present invention, to provide that the signal which corresponds to the pivot direction by the support arm to act through the angle detector during the pivoting operation to alter the operative range of the nozzles. The control signal from the microprocessor actuates only the valves of those nozzles or group of nozzles which are disposed in the front quadrant or third of that half of the drum periphery which is near the mineral face with respect to the direction of pivotal movement by the support arm. The instantaneous result of all the pivoting movements of the support arm is a shifting of the area on the mineral face which is engaged by the cutter picks in the direction of the pivoting movement by the support arm. In the absence of advancing movement, the cutter picks engage with the mineral face not at a low point of the periphery of the drum, but only when they have passed through a plane which has been determined by the axis of the drum extending parallel to the floor. Only the cutting tools an associated nozzles in the drum quadrant or in a third of the drum's periphery starting from this plane through the axis of the drum are in front of the mineral to be won and from which the cutting tools and their associated nozzles emerge. Consequently, due to pivoting movement of the support arm it is sufficient to supply liquid to only nozzles contained within this peripheral zone of the drum while automatic, adaptation of the zone as hereinbefore described, to the mineral face occurs only after termination of the pivotal movement of the support arm.

Shearer-cutter drums mounted on opposite ends of a shearer-loader for vertical displacement by a support arm, each include a microprocessor for controlling the discharge of fluid from nozzles on the trailing drum which wins coal from the floor. The microprocessor for the trailing drum which is dependent on the direction of machine travel receives a signal $\beta$ corresponding to the inclination of the support arm and a signal which corresponds to the direction of machine movement. The microprocessor actuates only those nozzles or group of nozzles disposed on the peripheral portion of the drum starting at the intersection of the mineral face side and a plane containing the longitudinal axis of the drum which plane intersects a longitudinal plane extending in a direction of the length of the support arm at right angles. The zone of actuated nozzles extends to a tangent which is parallel to the floor and at the lowest cutting point by the leading drum. The longitudinal plane extending the length of the support arm of the leading drum is parallel to the tangent. The zone of actuated nozzles is widened at the bottom beyond the plane containing the longitudinal axis by the central angle $\alpha$ corresponding to the angle of inclination $\beta$ of the trailing support arm. The top of the zone of actuated nozzles near the tangent widens or narrows by the central angle $\alpha$ of the leading drum which corresponds to the inclination angle $\beta$ of the support arm for the leading drum. Consequently, at the end of the mineral face where the direction of movement by the shearer-loader reverses, the drum which was previously the leading drum cutting the roof is now lowered to the floor and the previously trailing drum used to win coal from the floor is now raised to a position for cutting coal from the roof. The position of the zones of actuated nozzles on the peripheries of the drums are automatically adapted to the height of the mineral strip or coal seam presented to the shearer drums.

A shearer drum used particularly on a drifting or heading machine includes a longitudinal drum carried by a support arm mounted for pivotal movement about a horizontal axis and a vertical axis. According to a further feature of the present invention, two angle detectors are provided each to detect movement of the support arm about one of the two axes. The two angle detectors are connected to provide inputs to the microprocessor of the drum. The microprocessor responds during pivoting of the support arm to the signal corresponding to the respective pivoting direction of the drum by producing an output signal to open only the valves for those nozzles or group of nozzles which are disposed in front, as considered in the pivoting direction, of the face-half side of the drum periphery. This feature of the present invention enables energization of nozzles or a group of nozzles on the drum rotating about an axis which is parallel to the longitudinal axis of the support arm to thereby limit the energization nozzles in dependent relation upon the pivoting direction of the support arm to those zones of the periphery of the drum which are near the mineral face.

In other forms of mining machines known as a drifting or a heading machine, there are cutting drums mounted for rotation about an axis which is transverse to the length of a support arm for the cutting drums. The discharge pressurized liquid from nozzles can be controlled according to the present invention by means of a distance detector arranged to detect movement of the running gear of the machine relative to the floor or to detect displacement of the support arm for the cutter drums relative to the frame of the machine in a direction lengthwise of the roadway. The detector forms an output signal proportional to the distance traveled by the drum toward the drift or heading face. The output signal is fed to a microprocessor which is also responsive to a signal corresponding to the inclination of the support arm to energize only those nozzles or group of nozzles which are disposed immediately before the drift or heading face.

In a heading or a drifting machine where cutting drums are mounted to pivot about any axis, horizontal or vertical, extending transversely to the length of a support arm for the cutting drums, angle detectors are provided to detect horizontal and vertical pivotal movement about the axes. At the end of penetrating movement into a heading or drifting face, the angle detector responsive to horizontal pivotal every movement which is an adjustment to the support arm about an axis transverse to the length of the arm, limits the energization zone of the half of the drum which are energized by means of a vertical angle output signal from a detector responsive to movement of the support arm about a vertical pivot axis. Thus, the nozzles in the quadrant or correspondin third of the periphery of the drum half which is in front of the mine face supplied with pressurized liquid as considered in the vertical direction of pivotal movement by the support arm to compensate for vertical inclination of the support arm.

In all of the shearer or cutter drum constructions described hereinbefore, the microprocessor includes programs which are adapted to the operation of the drum and serve to actuate the valves to discharge pressurized liquid from the nozzles. The microprocessor is operative in response to one or more control signals produced by rotation of the cutter drum or by adjusting or movement of mechanisms of the drifting or heading machine or shearer-loader to actuate electrically-responsive members of control valves to connect the nozzles instantaneously near the mineral face with a supply of pressurized liquid in a supply line extending to the drum.

These features and advantages of the present invention as well as others will be more fully understood when the following description of a number of embodiments is read in light of the drawings wherein.

Figure 1:
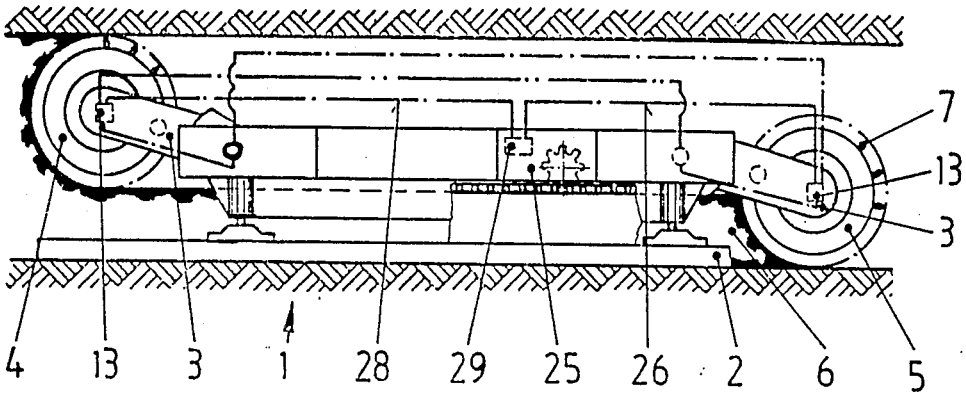
FIG. 1 is a side elevational view of a shearer-loader mining machine embodying the features of the present invention.
Figure 2:
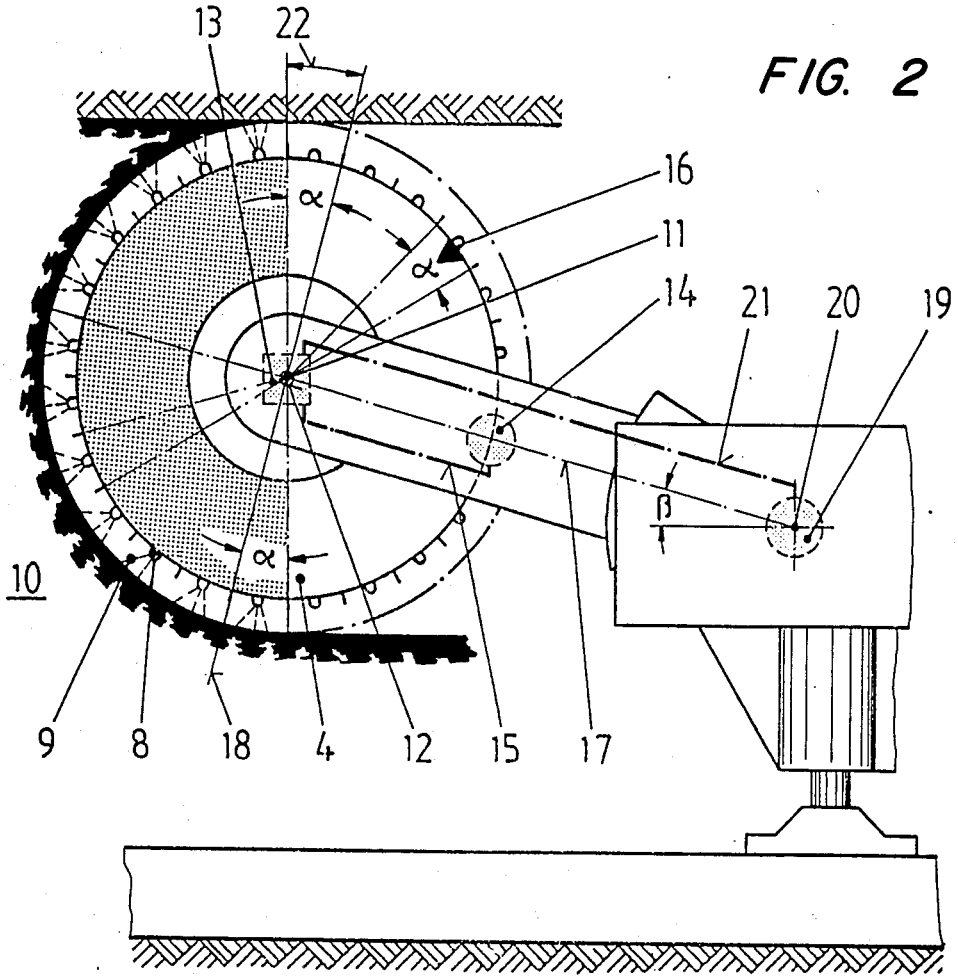
FIG. 2 is an enlarged partial view of a leading shearer drum for winning material from a mine roof by the shearer-loader machine shown in FIG. 1.
Figure 8:
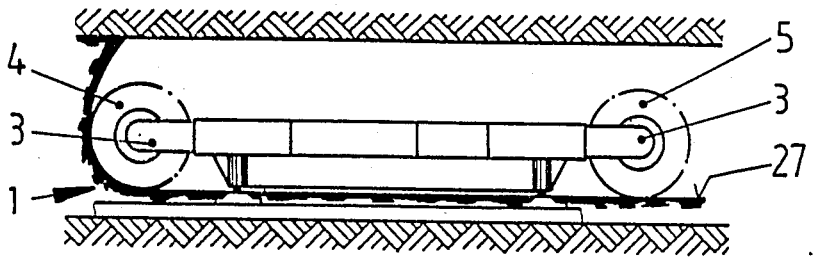
FIG. 8 is a further view of the machine shown in FIG. 1.

In FIGS. 1 and 8 there is illustrated a mining machine in the form of a drum cutter loader 1 which is movable back and forth across a mine face on a face conveyor 2. The drum cutter loader shown in FIG. 1 is arranged to win coal from a mine face while moving on the face conveyor in a direction from right to left. A support arm 3 is pivotally supported by a frame of the mining machine and is vertically adjusted to position a leading cutter or shearer drum 4 to perform a roof cut. Pivotally supported at the opposite end of the frame of the mining machine there is another support arm 3 which carries a shearer or cutter drum 5 at the trailing or rear portion of the mining machine to win floor coal identified by reference numeral 6. The floor coal remains behind and below the coal won by operation of the leading drum 4. Drum 5 is vertically adjusted by the support arm 3 so that it is guided for movement along the floor of the seam. The cutter drums 4 and 5 have cutter picks 7 and nozzles 8 distributed about the peripheries of the drums. Jets 9 of high-pressure water can be sprayed from nozzles 8 onto a mineral face 10 in order to facilitate the winning operation of the picks 7 and to reduce the accumulation of dust as well as to suppress sparking. A control facility is provided to ensure the delivery of high-pressure liquid always to only various ones of the nozzles 8 which are aimed at the mineral face 10. For this purpose, the nozzles 8 can be connected in groups or individually by way of solenoid operated valves located inside each of the drums 4 and 5 for delivering liquid from a liquid supply line 12 which extends along the axis 11 of the drum as shown in FIG. 2.

A microprocessor 13 is mounted inside the drum to control the operation of the solenoid valves. As best shown in FIG. 2, an initiator 14 provides a signal which is delivered to actuate the microprocessor 13 through a line 15 when a tag 16 passes by the initiator 14. The initiator 14 is secured for adjustable positioning on the side wall of the support arm. As the drum rotates, the tag cuts lines of magnetic flux emanating from the initiator 14 and thus produces a control signal which in turn causes the microprocessor 13 to produce a sequence of output pulses in which the timing, i.e., the time interval between output signals or pulses, of the pulses is adapted to the rotational speed of the drum 4. The signals or pulses form various control signals that actuate seriatim, at the cadence of the nozzles 8 or group of nozzles entering the mineral face 10 of the solenoid valves associated with each such nozzle or group of nozzles. The signal or pulse sequence is produced by the program of the microprocessor 13 to not only connect the nozzles 8 or group of nozzles to the liquid supply line 12 of the drum but also interrupt communication of the nozzles 8 or group of nozzles emerging from the face near the roof with the liquid supply line.

The nozzles of the drum which are supplied with high-pressure liquid in this manner extend in a dependent relation to the program of the microprocessor 13, over a semi-circle of the drum 4, i.e., over 180 degree arc bounded by a plane 18 which extends perpendicular to the longitudinal axis 17 of the support arm. This zone correlates with the operative zone of the cutter pick 7 of the drum engaged with the material when the support arm 3 of the drum extends parallel to the floor. However, when the arm 3 is moved to an inclined position as shown in FIG. 2, i.e., the arm is moved to an angle of inclination $\beta$, with respect to the floor or roof, the range of engagement of the picks and, therefore, the operative zone of the nozzles 8 or group of nozzles has been displaced by the inclination angle $\beta$ against the direction of pivotal movement by the support arm 3.

The control of the present invention operates in response to movement of the support arm by delivering to the microprocessor a signal in line 21 from an angle detector 19 which is disposed along the pivot axis 20 of the support arm. The angle detector 19 produces a control signal corresponding to the inclination angle $\beta$ which causes the microprocessor to correct the zone of actuated nozzles on the drum when the support arm inclination reaches an angle $\alpha$ or an integral multiple thereof. The angle $\alpha$ corresponds to the angle subtended at the center of the drum by a circumferential arc 22 of the drum occupied by a group of nozzles or a single nozzle. When a signal of this magnitude from the detector 19 is fed to the microprocessor 13, upon completion of pivotal movement of the support arm, the microprocessor 13 effectively shifts the zone of actuated nozzles 8 or groups of nozzles in a dependent relation upon the inclination of the support arm 3. The shift to the zone of actuated nozzles corresponds to one or more arc portions 22 of the drum against the direction of pivotal movement by the support arm 3 and, as shown in FIG. 2, correlates the operative zone of the nozzles 8 up to an amount corresponding approximately to the inclination of the support arm angle $\beta$ with the position of the mineral face 10.

Figure 3:
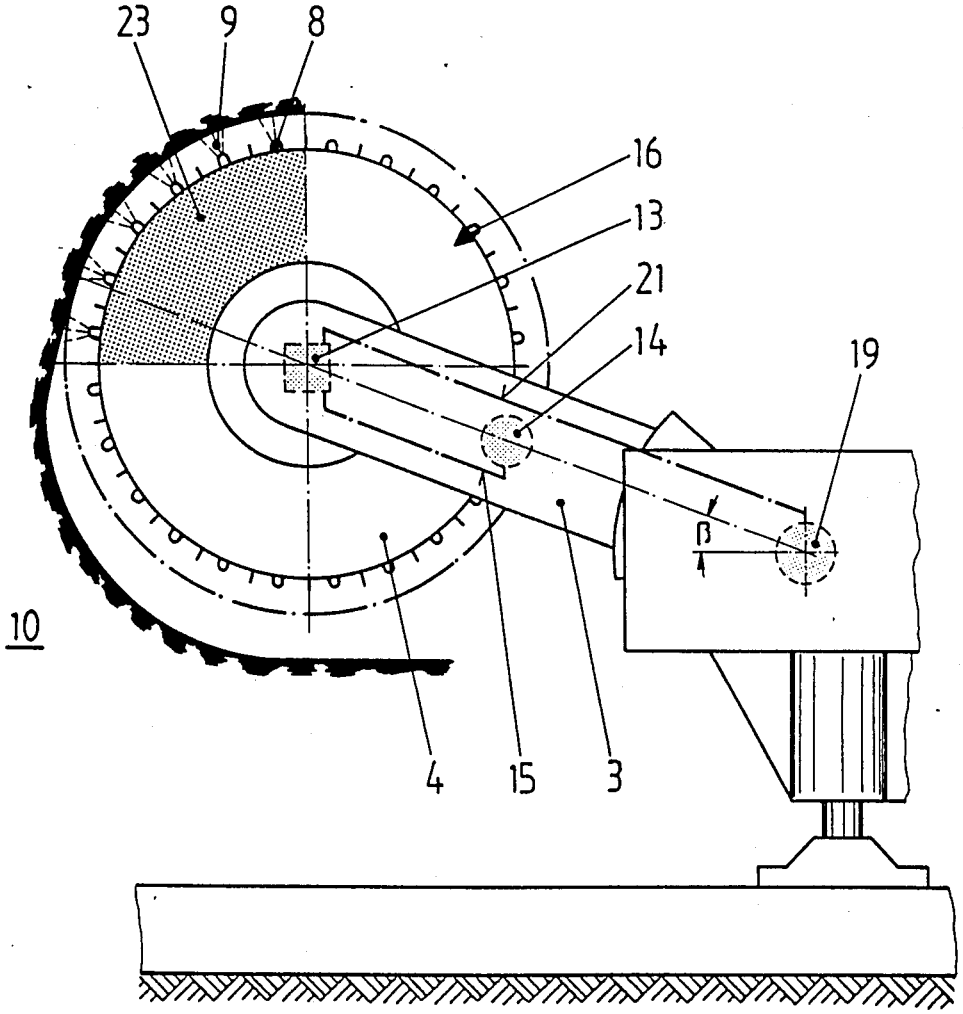
FIG. 3 is an enlarged partial view similar to FIG. 2 and illustrating pivotal movement of the support arm for the leading shearer drum in a direction indicated by an arrow.

An alternative arrangement, as shown in FIG. 3, provides that the angle detector 19 again detects the inclination angle $\beta$ of the support arm with respect to the floor or the roof. The detector delivers a signal to the microprocessor 13 so that control signals in the form of output pulses from the microprocessor energize solenoid valves for the nozzles 8 or group of nozzles only when they are disposed inside the face side quadrant 23 or a quarter of the periphery of the drum 4 which is at the front of the mineral face as considered in the direction of pivotal movement of the arm 3. Consequently, high-pressure liquid is supplied during the actual pivoting step only to the nozzles 8 or group of nozzles which together with the cutter pick 7 are disposed in or in front of the face 10 during pivotal movement of the support arm.

During the cutting or shearing movement when the leading drum 4 makes a roof cut, the trailing drum 5 is used to win coal from the coal floor 6 which remains below the leading drum 4. The height of the seam at the coal floor 6 depends upon the inclination angle $\beta$ of the support arm 3 for the front drum as well as upon the diameter of the leading drum. The height of the floor coal 6, therefore, varies with the adjustment of the support arm for the leading drum. Consequently, the peripheral zone 24 of the drum 5 containing the nozzles or group of nozzles to be energized by operation of the solenoid valves also varies.

Figure 4:
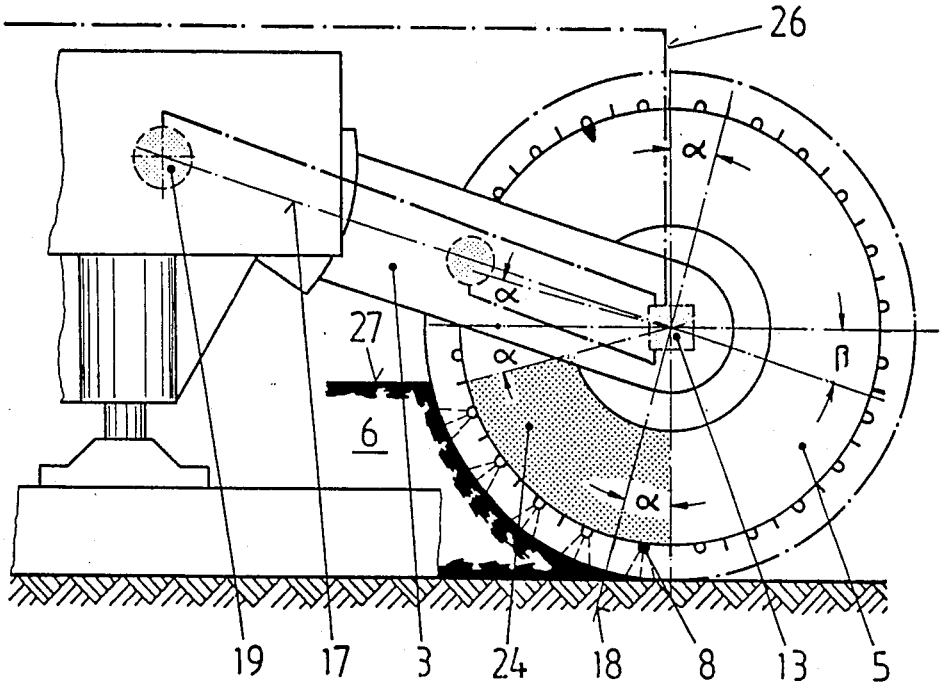
FIG. 4 is an enlarged partial view of only a trailing drum cutter of the shearer-loader mining machine shown in FIG. 1 operating at a coal floor.

As can be seen from FIG. 4, by way of an example, a haulage box 25 (FIG. 1) supplies a control signal through line 26 to the microprocessor for the trailing drum 5. The signal in line 26 provides a continuous indication to the microprocessor as to whether the drum 5 is operative in a leading or trailing capacity. When the signal in line 26 is present at the microprocessor 13 of the trailing drum 5 together with a control signal from the angle detector 19 of the trailing support arm 3, the microprocessor energizes by way of its output pulses only the solenoid valve or valves associated with nozzles 8 or a group of nozzles which are disposed within the peripheral zone 24 of the trailing drum 5. The zone 24 is determined by one of the programs of the microprocessor. Zone 24 is limited by the plane 18 which extends through the rotational axis of the drum at a point perpendicular to the longitudinal axis 17 of the support arm. Zone 24 is further defined by a plane 27 which is a tangent to the lowest point of the leading drum 4 when the support arm 3 therefor is disposed parallel to the floor as shown in FIG. 8. The zone 24 covered by the trailing drum is always completed by operation of the microprocessor 13 for the trailing drum through a widening of the peripheral zone corresponding to the pivotal angle $\beta$ of the trailing support arm 3. The zone 24, therefore, enlarges toward the floor by the center angle $\alpha$ corresponding to the pivotal angle $\beta$ of the trailing support arm 3 and the zone 24 enlarges upwardly by the central angle $\alpha$ of the drum 4, the latter angle corresponding to the pivot angle $\beta$ of the front support arm 3 when the support arm 3 of the drum 4 is inclined upwardly. The zone 24 decreases in the event of a downward inclination of the support arm by the center angle $\alpha$ corresponding to the latter inclination angle $\beta$. Thus, the increases or reductions to the energization zone 24 of the trailing drum 5 are produced by the inclination angles $\beta$ of the two support arms 3. These inclination angles are supplied by way supplying corresponding signals to the microprocessor 13 for the trailing drum.

The microprocessors 13 for the two drums 4 and 5 are connected by way of control lines 26 and 28 (FIG. 1) to a detector 29 in the haulage box 25. While not shown, there is also a line connecting the two microprocessors 13 to the angle detectors 19 not only of the support arm 3 of the drum 4 but also to the angle detector 19 of the support arm 3 for the drum 5 at the other end of the mining machine.

Figure 5:
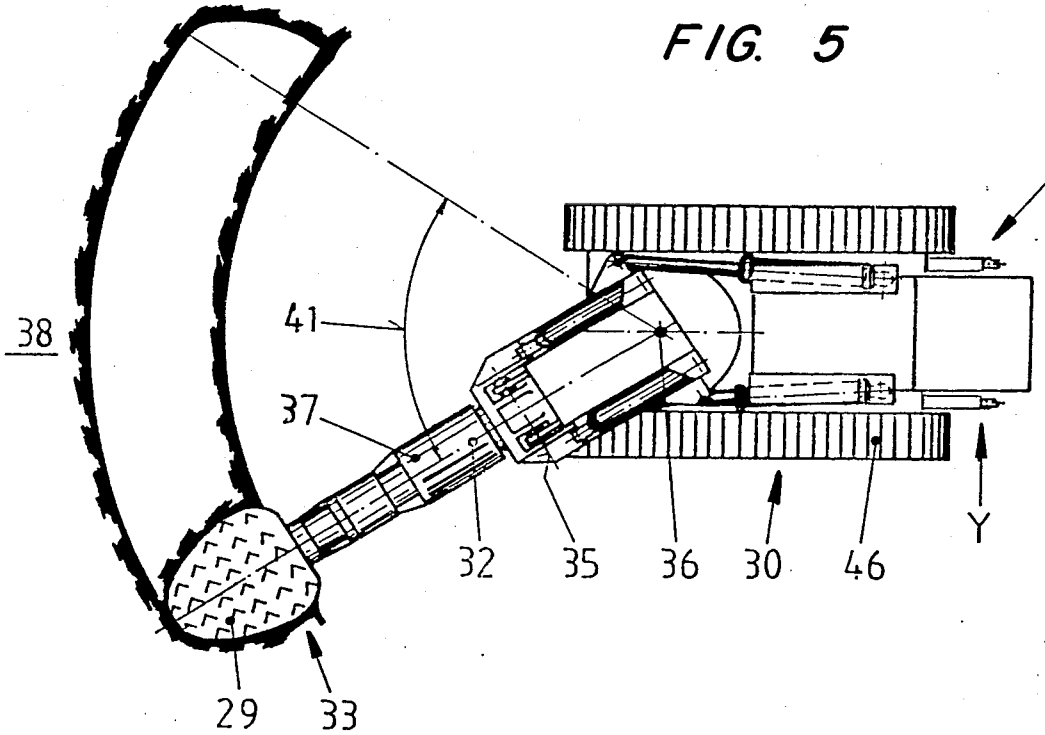
FIG. 5 is a plan view of a heading or drifting machine in which a shearing drum is carried by a support arm to rotate about an axis extending in the direction of the length of the support arm.
Figure 6:
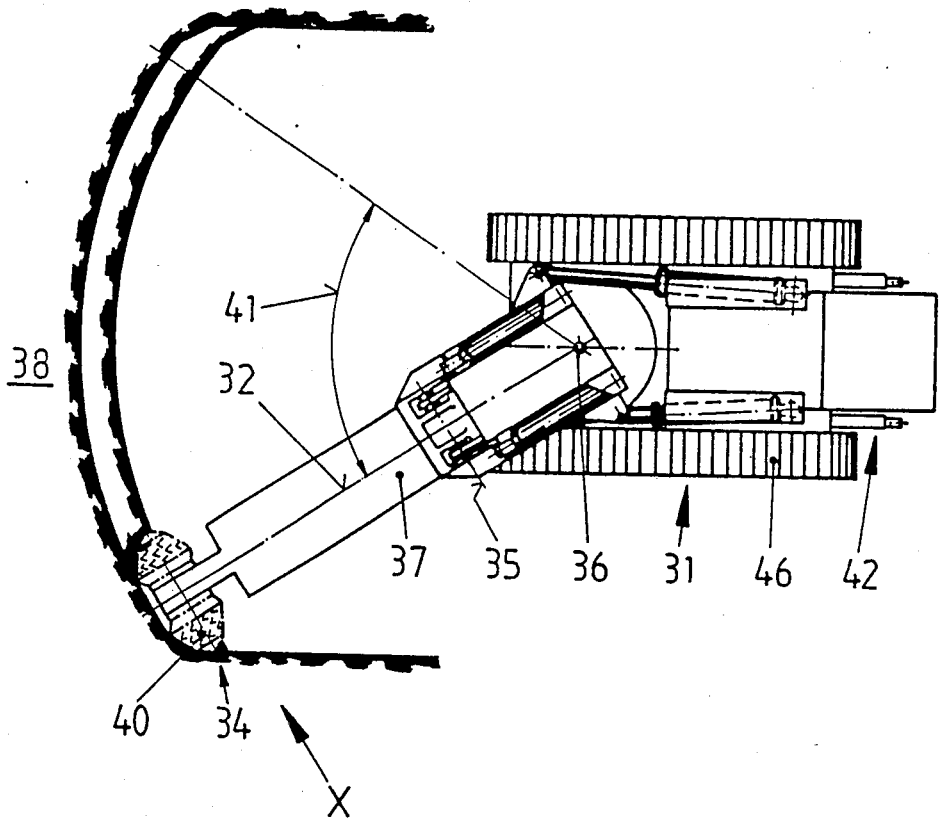
FIG. 6 is a plan view of a drifting or heading machine having a shearer drum carried by a support arm to rotate about an axis transverse to the length of the support arm.

In FIG. 5, there is illustrated a heading machine 30 and in FIG. 6 there is illustrated a drifting machine 31. Heading machine 30 includes a shearer drum 33 carried at the outer end of a support arm 37 to rotate about a longitudinal axis 32 of the support arm. The support arm is connected to the heading machine to pivot about axes 35 and 36. Angle detectors 19A and 19B are connected to the structure forming pivot axes 35 and 36 respectively to detect pivotal movement about the axes 35 and 36. The detectors deliver corresponding signals by lines connected to a microprocessor 13A located inside the shearer drum 33. The microprocessor includes a program to produce output pulses delivered to operate solenoid valves for connecting a supply of high-pressure liquid to only the nozzles or groups of nozzles on the periphery of the drum when disposed opposite the heading face 38 during pivotal movement of the support arm. In FIG. 5, the nozzles on the peripheral half 39 of the drum 33 operate to discharge liquid through the energization of the solenoid valves associated with the nozzles. When the direction of pivotal movement of the support arm changes, only the nozzles in the peripheral half portion 39 of the drum which is at the front of the material to release from the heading face, as considered in the pivoting direction 41, are always supplied with pressurized liquid. The angle detector 19A responding to movement about horizontal axis 35 controls energization of the nozzles or groups of nozzles during horizontal movement of the support arm. The angle detector 19B responds to pivotal movement about vertical axis 36 to insure a corresponding energization of nozzles in response to vertical movements of the drum 33.

In FIG. 6 the drifting machine 31 includes a shearer drum 24 carried at the outer end of a support arm 37A. Drum 33 rotates about an axis which is perpendicular to axis 32 of the support arm. The support arm is connected to the heading machine to pivot about axes 35A and 36A. Angle detectors 19C and 19D are connected to structures forming pivot axes 35A and 36A respectively to detect pivotal movement about the axes 35A and 36A. The detectors deliver corresponding signals by lines connected to a microprocessor 13B inside the shearer drum 34. The microprocessor includes a program to produce output pulses delivered to operate solenoid valves for connecting a supply of high-pressure liquid to only the nozzles or group of nozzles about the periphery of the drum when disposed opposite the drifting face 38A during pivotal movement of the support arm. The nozzles on the peripheral half 40 of the shearer drum 33 operate to discharge liquid through energization of the solenoid valves associated with the nozzles. When the direction of pivotal movement of the support arm changes, only the nozzles in the peripheral half portion 40 of the drum which is at the front of the material to release from the drifting face, as considered in the pivoting direction 41A, are always supplied with pressurized liquid. The angle detector 19C and 19D respond to movement about horizontal axis 35A and vertical axis 36A respectively to ensure a corresponding energization of nozzles or groups of nozzles in response to horizontal movements of the drum 34

Figure 7:
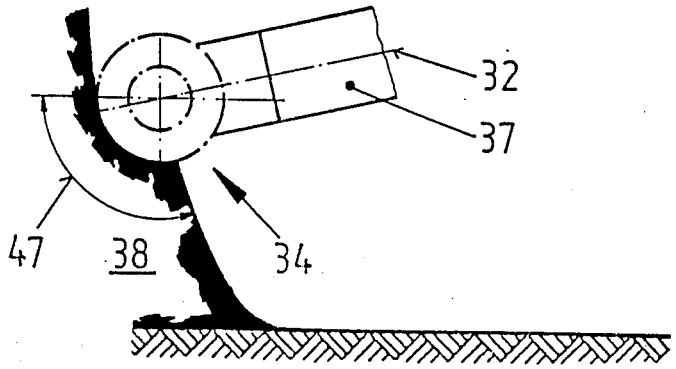
FIG. 7 is an elevational view taken in the direction of arrow X in FIG. 6.
Figure 9:
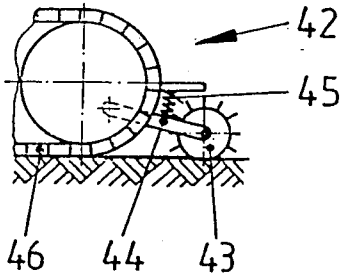
FIG. 9 is an elevational view taken in the direction of arrow Y of the machine shown in FIG. 5.

When the drifting machine 31 is provided on the cantilever end of the support arm 37A with the drum 34 to rotate transversely to the longitudinal axis 32, the machine can, as shown in FIG. 6, be provided with a distance detector 42. In the embodiment illustrated in FIG. 9, the detector 42 takes the form of a wheel 43 arranged on the machine to roll along the floor in the working area of the machine. The wheel 43 is pivotally mounted on a jib or cantilever arm 44 and a spring 45 is arranged between the arm and a machine frame part to press the wheel 43 into engagement with the floor. Rotation of the wheel 43 is sensed by a detector which provides a displacement signal proportional to the displacement of the machine running gear 46. The displacement signal from the detector of wheel 43 is supplied to the microprocessor 13B for the cutter drum 34. The program of the microprocessor produces an output signal to energize during penetrating movement, as shown in FIG. 7, of the transversely-arranged drum 34 only that peripheral arc 47 of the drum whenever the running gear 46 is operating to cause the drum to enter the heading or drifting face 38A. Only at the onset of lateral pivoting movement in the direction indicated by reference numeral 41 (FIG. 6) will the angle detector 19D respond to horizontal pivoting of the arm about axis 36 to produce a signal which restricts energization of nozzles on the peripheral half portion 40 which is leading, the restriction applies to the peripheral portion 47 which is in the face 38 as determined by the depth of penetrating movement. At the end of the pivotal movement when the drum has reached the roadway face and is raised or lowered by the support arm to press the drum into the mineral below or above it, the vertical pivoting movement triggers a signal from detector 19C which is supplied to the microprocessor of the drum. This further restricts the energization zone 47 of the nozzles and limits the zone of nozzles which is energized to the quadrant shown in FIG. 7 and identified by reference numeral 47. This zone corresponds to the front third of the periphery of the drum as determined by the depth of penetration of the drum into the working face. Subsequent pivotal movement of arm 37 in the opposite direction causes, through the production of an output signal from detector 19C associated with axis 35, a displacement of the previous energization zone 47 from the drum half 40 which is now trailing to the drum half which is now leading. While not specifically described in connection with the embodiments of the heading or drifting machines shown in FIGS. 5–9, it is to be understood that an initiator and tag of the type shown for example in FIG. 2 and described in connection therewith are preferably included as part of the control system for the heading or drifting machines. The description given heretofore of the relationships of one or more initiators and tags applies with equal effect to the cutter drum and support arm therefor.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a mining machine used in underground mining, the combination of a cutter drum, nozzles distributed in rows about the periphery of said drum for discharging pressurized liquid outwardly from said drum, liquid control valve means for controlling the supply of pressurized liquid to each nozzle or a group of nozzles, at least one initiator means responsive to rotation of said drum for producing a signal, and microprocessor means responsive to the signal produced by said initiator means for controlling said valve means for limiting the discharge of pressurized liquid from said nozzles toward only that part of the mineral face which is in front of said drum.

2. The combination according to claim 1 wherein said initiator means includes an initiator sensor to deliver a signal to said microprocessor means for each control valve means.

3. The combination according to claim 1 wherein the initiator means comprises a single initiator sensor for producing an output signal at each revolution of said drum, said microprocessor means responding to said output signal by producing control signals in timed sequence with the speed of rotation of said drum for operating said valve means to supply pressurized liquid to said nozzles.

4. The combination according to claim 1 further including a vertically-displaceable support arm for rotatably supporting said drum, a tag carried by said drum to rotate therewith, said initiator means including an initiator sensor supported adjacent to said drum, and non-rotatable therewith for producing lines of flux which can be cut by said tag when rotated with said drum; and means for adjusting the position of said tag about the drum so as to alter the times in which said initiator means carried by said support arm produces said signal.

5. The combination according to claim 1 further including a pivot arm for vertically displacing said drum, a detector for delivering an input signal to said microprocessor means corresponding to an inclination angle $\beta$, between said support arm and the floor, said microprocessor means responding to said input signal by controlling the dischrage of pressurized liquid from nozzles within a peripheral circular surface of the drum defined by an angle $\alpha$ corresponding to inclination angle $\beta$.

6. The combination according to claim 5 wherein said angle "A" is an integer multiple of said inclination angle "B".

7. The combination according to claim 5 wherein said angle $\beta$ corresponds to the angle subtended at the center of said drum by the interval between two consecutive rows of nozzles which extend across the drum width.

8. The combination according to claim 5 wherein said angle $\alpha$ corresponds to the angle subtended at the center of said drum by said group of nozzles.

9. The combination according to claim 1 further including a support arm pivotally carried by a frame of the mining machine for rotatably supporting said drum, a rotation detector for producing a pivot signal corresponding to the direction of pivotal movement by said support arm, said microprocessor means being responsive to said pivot signal for varying the operation of said valve means to control the discharge of pressureized liquid from nozzles or group of nozzles disposed in front of a quadrant of the drum periphery which is near the mineral face.

10. A mining machine used in underground mining, the combination including a mining machine frame having support arms supported to pivot vertically at opposite ends thereof, a cutter drum extending toward a mineral face rotatably supported by each support arm, said machine frame being movable back and forth along a mine face whereby a cutter drum at one end of the machine frame alternately becomes a leading cutting drum and a trailing cutting drum, nozzles distributed about the periphery of each cutting drum for discharging pressurized liquid outwardly of the cutter drums, liquid control valve means for controlling the supply of pressurized liquid to each nozzle or a group of nozzles of each cutter drum, initiator means carried by each support arm to respond to rotation of the cutter drum supported thereby for producing a signal, an inclination detector for each support arm to produce a pivot signal corresponding to an inclination angle $\beta$ of the support arm with respect to the mining machine frame, means for producing a machine direction signal corresponding to the direction of movement by the machine frame along a mine face, and microprocessor means for at least said trailing cutting drum responsive to the signals produced by said intitiator means and said inclination detector and responsive to said machine direction signal for controlling said valve means to limit the discharge of pressurized liquid from only those nozzles or groups of nozzles situated in a zone on the periphery of the cutter drum, said zone extending towards the mineral face from a longitudinal plane which extends through a rotational axis of the drum and intersects at right angles an axis extending along the length of the support arm for the drum, said zone extending to a line parallel to the floor of the mine at the lowest cutting point by the leading drum when the support arm therefor is parallel to the floor of the mine, the zone of the energized nozzles being widened at the bottom of the trailing drum beyond said longitudinal plane by a central angle $\alpha$ corresponding to the inclination angle $\beta$ of the trailing support arm, the top of said zone being widened or narrowed by the central angle $\alpha$ of the leading drum which corresponds to an inclination anlge $\beta$ of the leading support arm.

11. A drifting or heading machine to release material from a mine face, said machine including a cutter drum adapted to rotate about a rotational axis, nozzles distributed about the periphery of the drum for discharging pressurized liquid outwardly from the drum, liquid control valve means for controlling the supply of pressurized liquid to each nozzle or a group of nozzles, a support carrying said cutter drum and mounted on a machine frame to pivot about a horizontal axis and a vertical axis, detector means responsive to pivotal movement of the support arm with respect to the machine frame for producing a horizontal pivot signal corresponding to pivotal movement about said horizontal axis and for producing a vertical pivot signal corresponding to pivotal movement about said vertical axis, and microprocessor means responsive to said horizontal pivot signal and said vertical pivot signal for controlling said valve means for discharging pressurized liquid from nozzles or a group of nozzles disposed on the face half side of the drum periphery in front of the mine face during pivotal movement of said arm.

12. The drifting or heading machine according to claim 11 in which said cutter drum rotates about an axis which is transverse to the extended length of said support arm and the combination further including distance detector means responsive to advancing movement of the cutter drum in a direction lengthwise of a roadway of the mine floor for forming an output signal proportional to the distance of travel by the cutter drum towards the mine face, said microprocessor receiving the signal from said distance detector for controlling said valve means to energize the nozzles or a group of nozzles disposed immediately before the mine face near the material to be won.

13. The drifting or heading machine according to claim 12 wherein said distance detector includes means responsive to advancing movement by a machine frame which carries said support arm for advancing movement along the roadway of the mine floor.

14. The drifting or heading machine according to claim 11 wherein said cutter drum rotates about an axis extending transversely to the extended length of said support arm, and wherein said microprocessor means responds to said horizontal pivot signal and said vertical pivot signal produced by said detector means in response to movement of said support arm about said vertical axis for limiting the zone of nozzles which is energized to half of the periphery of the drum, said zone being further restricted to the quadrant or third of the periphery of the drum half which is in front of the mine face by an output signal from the angle detector means responsive to pivotal movement of the support about said horizontal axis.

15. The machine according to claim 11 wherein said microprocessor means includes programs responsive to control signals produced by rotation of the cutter drum.

16. The machine according to claim 11 wherein said microprocessor means includes programs responsive to control signals produced by pivotal adjusting means for the cutter drums.

17. The machine according to claim 11 wherein said microprocessor means includes programs responsive to control signals produced by movement of the machine frame.

18. In a mining machine used in underground mining, the combination including a mining machine frame having support arms supported to pivot at the opposite ends thereof, a cutter drum rotatably supported by each support arm, said machine frame being movable back and forth along a mine face whereby a cutter drum at one end of the machine frame alternately becomes a leading cutting drum and a trailing cutting drum, nozzles distributed in rows about the periphery of each cutter drum for discharging pressurized liquid outwardly from the cutter drums, liquid control valve means for controlling the supply of pressurized liquid to each nozzle or a group of nozzles of each cutter drum, initiator means carried by each support arm to respond to rotation of the cutter drum supported thereby for producing a signal, and microprocessor means responsive to the signal produced by each said initiator means carried by the respective support arm for controlling said rotatably therewith for producing lines of flux which can be out by said tag when rotated with said drum; and means for adjusting the position of said tag about the drum so as to alter the times in which said initiator means carried by said support arm produces said signal.

19. The combination according to claim 18 wherein each of said initiator means carried by each support arm includes an initiator sensor to deliver a signal to said microprocessor means for each control valve means.

20. The combination according to claim 18 wherein each of the initiator means carried by each support arm comprises a single initiator sensor for producing an output signal at each revolution of each cutter drum, respectively, said microprocessor means responding to said output signal of each initiator means by producing control signals in timed sequence with the speed of rotation of said drums for operating said valve means of each cutter drum to supply pressurized liquid to said nozzles of each cutter drum.

21. The combination according to claim 18 further including a tag attached to each cutter drum to rotate therewith, each of said initiator means including an initiator sensor supported adjacent to each cutter drum, and non-rotatable therewith for producing lines of flux which can be cut by said tag when rotated by said drum; and means for adjusting the position of each of said tags about the drum so as to alter the times in which each of said initiator means carried by each support arm produces said signal respectively.

22. The combination according to claim 18 further including a detector for each support arm for delivering an input signal to said microprocessor means corresponding to an inclination angle $\beta$ between the resepctive support arm and the floor along which the mining machine moves, said microprocessor means responding to said input signal by controlling the discharge of pressurized liquid from nozzles of the respective cutter drum within a peripheral circular surface of the drum of the respective cutter drum defined by an angle $\alpha$ corresponding to said inclination angle $\beta$.

23. The combination according to claim 5 wherein said angle $\alpha$ is an integer multiple of said inclination angle $\beta$.

24. The combination according to claim 5 wherein said angle $\alpha$ corresponds to the angle subtended at the center of the respective cutter drum by the interval between two consecutive rows of nozzles which extend across the cutter drum width.

25. The combination according to claim 18 further including a rotation detector for each support arm for producing a pivot signal corresponding to the direction of pivotal movement by the respective support arm, said microprocessor means being responsive to said pivot signal for varying the operation of said valve means of the respective cutter drum to control the dischrage of pressurized liquid from nozzles or groups of nozzles disposed in front of a quadrant of the respective cutter drum periphery which is near the mineral face.

* * * * *